US007077192B2

(12) United States Patent
Avequin et al.

(10) Patent No.: US 7,077,192 B2
(45) Date of Patent: Jul. 18, 2006

(54) MANIFOLD WITH INTEGRATED PIPE FOR A HEAT EXCHANGER

(75) Inventors: Stéphane Avequin, Versailles (FR); Carlos Martins, Montfort L'Amaury (FR)

(73) Assignee: Valeo Thermique Moteur, La Verriere (FR)

( * ) Notice: Subject to any disclaimer, the term of this patent is extended or adjusted under 35 U.S.C. 154(b) by 72 days.

(21) Appl. No.: 10/691,531

(22) Filed: Oct. 24, 2003

(65) Prior Publication Data

US 2004/0244956 A1 Dec. 9, 2004

Related U.S. Application Data

(63) Continuation of application No. 09/791,644, filed on Feb. 26, 2001, now abandoned.

(30) Foreign Application Priority Data

Feb. 24, 2000 (FR) ..... 00 02327

(51) Int. Cl.
*F28F 9/02* (2006.01)
*F28F 1/24* (2006.01)
*F28D 1/00* (2006.01)

(52) U.S. Cl. ..... 165/173; 165/76; 165/148; 165/174; 165/175

(58) Field of Classification Search ..... 165/76, 165/148, 173, 174, 175
See application file for complete search history.

(56) References Cited

U.S. PATENT DOCUMENTS

| | | | | |
|---|---|---|---|---|
| 3,866,675 | A * | 2/1975 | Bardon et al. | 165/173 |
| 4,023,618 | A * | 5/1977 | Kun et al. | 165/175 |
| 4,183,402 | A * | 1/1980 | Cotter | 165/175 |
| 4,295,521 | A * | 10/1981 | Sommars | 165/69 |
| 4,331,201 | A * | 5/1982 | Hesse | 165/153 |
| 4,531,578 | A * | 7/1985 | Stay et al. | 165/175 |
| 4,997,035 | A * | 3/1991 | Beatenbough et al. | 165/173 |
| 5,178,211 | A * | 1/1993 | Bauer et al. | 165/153 |
| 5,205,354 | A * | 4/1993 | Lesage | 165/173 |
| 5,447,192 | A * | 9/1995 | Woerner et al. | 165/81 |
| 5,450,896 | A | 9/1995 | Bertva et al. | |
| 5,538,079 | A * | 7/1996 | Pawlick | 165/153 |
| 5,607,012 | A | 3/1997 | Buchanan et al. | |

(Continued)

FOREIGN PATENT DOCUMENTS

EP 0 532 794 A 3/1993

(Continued)

*Primary Examiner*—Henry Bennett
*Assistant Examiner*—Nihir Patel
(74) *Attorney, Agent, or Firm*—Liniak Berenato White

(57) ABSTRACT

A manifold for, e.g. a motor vehicle heat exchanger, has a first part formed from a shaped metal sheet and bottom and two lateral walls folded face-to-face, at least one of which is provided with an aperture for fixing a pipe there. A second part is shaped metal sheet and able to be fitted onto the lateral walls of the first part to form a cover opposite the bottom of this first part. Either the first part or the second part has a manifold plate. The first part, the second part and the pipe are assembled by brazing.

15 Claims, 5 Drawing Sheets

U.S. PATENT DOCUMENTS

| | | | | |
|---|---|---|---|---|
| 5,645,125 | A * | 7/1997 | Kroetsch et al. | 165/137 |
| 5,934,365 | A | 8/1999 | Rhodes et al. | |
| 6,115,918 | A | 9/2000 | Kent | |
| 6,161,616 | A | 12/2000 | Haussmann | |
| 6,179,050 | B1 | 1/2001 | Dey et al. | |
| 6,247,232 | B1 * | 6/2001 | Lambert et al. | 29/890.043 |
| 6,296,051 | B1 | 10/2001 | Sahnoun et al. | |
| 6,328,100 | B1 * | 12/2001 | Haussmann | 165/176 |

FOREIGN PATENT DOCUMENTS

| | | | |
|---|---|---|---|
| EP | 0 718 589 | | 12/1995 |
| EP | 0 718 580 | A | 6/1996 |
| EP | 0 777 097 | A1 | 6/1997 |
| FR | 2 524 977 | A | 10/1983 |
| FR | 2614-408 | A | 4/1987 |

* cited by examiner

MANIFOLD WITH INTEGRATED PIPE FOR A HEAT EXCHANGER

This is a Continuation Application of U.S. patent application Ser. No. 09/791,644 filed on Feb. 26, 2001 now abandoned. The disclosure of the prior application is hereby incorporated by reference herein in its entirety.

FIELD OF THE INVENTION

The invention relates to heat exchangers, especially for motor vehicles, and more particularly to a manifold for a heat exchanger, comprising a manifold plate closed by a wall in such a way as to delimit a chamber into which at least one pipe opens out.

BACKGROUND OF THE INVENTION

In a manifold of this sort, the manifold plate, which is also called hole plate, possesses a multiplicity of holes in which are accommodated the extremities of tubes which constitute the core of the heat exchanger. Fins contributing to increasing the heat-exchange surface area are associated with these tubes.

The manifold plate is closed by a wall so as to delimit a chamber which communicates with the tubes in order to allow a fluid to circulate in the core.

The abovementioned wall is usually equipped with at least one pipe to allow the abovementioned fluid to enter or leave.

The design of these pipes poses many problems in practice, given that they have to be placed at precise places on the wall depending on the conditions dictated by the placing of the heat exchanger in the vehicle in question.

Moreover, the pipe has to be shaped in a particular way, for example bent, in order to present an end part extending in a given direction in order for a flexible hose to be fitted over it.

Manifolds of this sort are already known, in which the manifold plate is of metal, while the wall is molded from plastic with the pipe or pipes which are associated with it.

In this case, leaktightness between the manifold plate and the wall is ensured by means of a gasket, the manifold plate being equipped with claws which are folded down or crimped against a peripheral rim of the wall.

The production of such a wall with at least one associated pipe requires molds of complex shapes.

Manifolds of this sort are also known in which the various elements are metal pieces assembled together by brazing.

Here again, that poses difficulties in producing and installing the pipe at an appropriate place, especially when this pipe is bent.

The object of the invention is especially to overcome the abovementioned drawbacks.

SUMMARY OF THE INVENTION

According to the present invention there is provided a manifold for a heat exchanger, having a manifold plate closed by a wall in such a way as to delimit a chamber into which at least one pipe opens out, and further comprising a first part formed from a shaped metal sheet featuring a bottom and two lateral walls folded face-to-face, at least one of which is provided with an aperture in order for a pipe to be affixed there and a second part formed from a shaped metal sheet able to be fitted onto the lateral walls of the first part in order to form a cover opposite the bottom of this first part, wherein one of the first part and the second part comprises the manifold plate, and wherein the first part, the second part and the pipe are assembled by brazing.

It is thus possible to produce all the elements of the manifold, including the pipe, from metal pieces, shaped especially by stamping, which are then assembled by brazing.

Thus, the constituent elements of the manifold can be brazed in an oven, at the same time as the rest of the heat exchanger, which markedly simplifies the manufacturing operations.

Advantageously, the two lateral walls of the first part are generally flat and parallel to each other and are connected perpendicularly to the bottom.

It is advantageous for the two lateral walls of the first part each to include a peripheral groove for accommodating a longitudinal edge of the second part. This contributes to correct temporary holding of the first part and of the second part together.

In a variant, this temporary holding can be obtained by the fact that the two lateral walls of the first part each include a series of cut-outs delimiting support regions formed in projection from the inner side for accommodating a longitudinal edge of the second part.

These support regions are preferably each formed by stamping of the lateral walls of the inner side.

In order to contribute to the holding, it is preferable for each longitudinal edge of the second part to be equipped with projecting studs able to be engaged respectively in the cut-outs of the lateral walls.

According to yet another characteristic of the invention, the second, cover-forming part is defined by a sheet which is shaped so as to have generatrices generally parallel to each other.

In a first embodiment of the invention, the manifold plate is included in the bottom of the first part and is connected to the lateral walls, while the second part constitutes a closed cover.

In this case, the two lateral walls advantageously possess respective face-to-face extensions, at least one of which is provided with an aperture for the pipe.

In a second embodiment of the invention, the manifold plate is included in the second part, while the bottom of the first part is closed and is connected to the lateral walls.

In the invention, the first part and the second part are each obtained by stamping and cutting out from a metal sheet. The latter is advantageously a sheet of a material comprising aluminum.

According to another aspect, the invention relates to a heat exchanger comprising at least one manifold as defined above.

BRIEF DESCRIPTION OF THE DRAWINGS

In the description which follows, given solely by way of example, reference is made to the attached drawings, in which.

DESCRIPTION OF THE PREFERRED EMBODIMENTS

Figure 1:
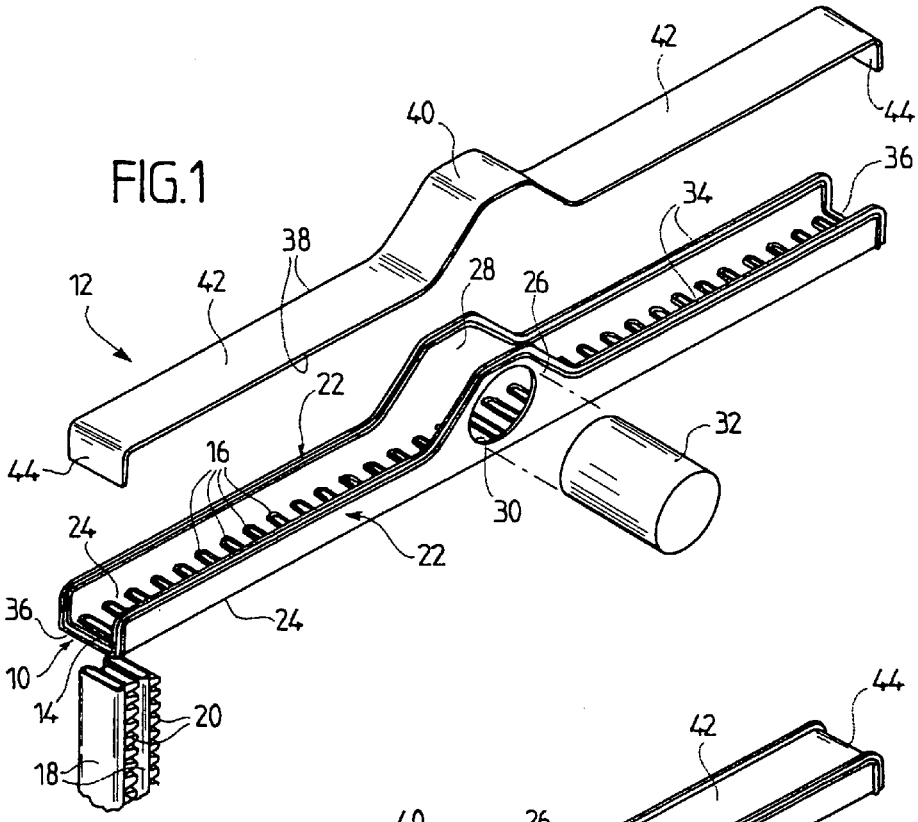
FIG. 1 is an exploded view in perspective of a manifold according to a first embodiment of the invention.

In the various figures, like reference numerals refer to like parts, unless otherwise specified.

The embodiment of FIGS. 1 to 7 will be referred to first of all, in which the manifold comprises a first part 10 and a second part 12 each formed from a metal sheet, advantageously of aluminum, which is shaped by conventional cutting-out and stamping operations.

Figure 2:
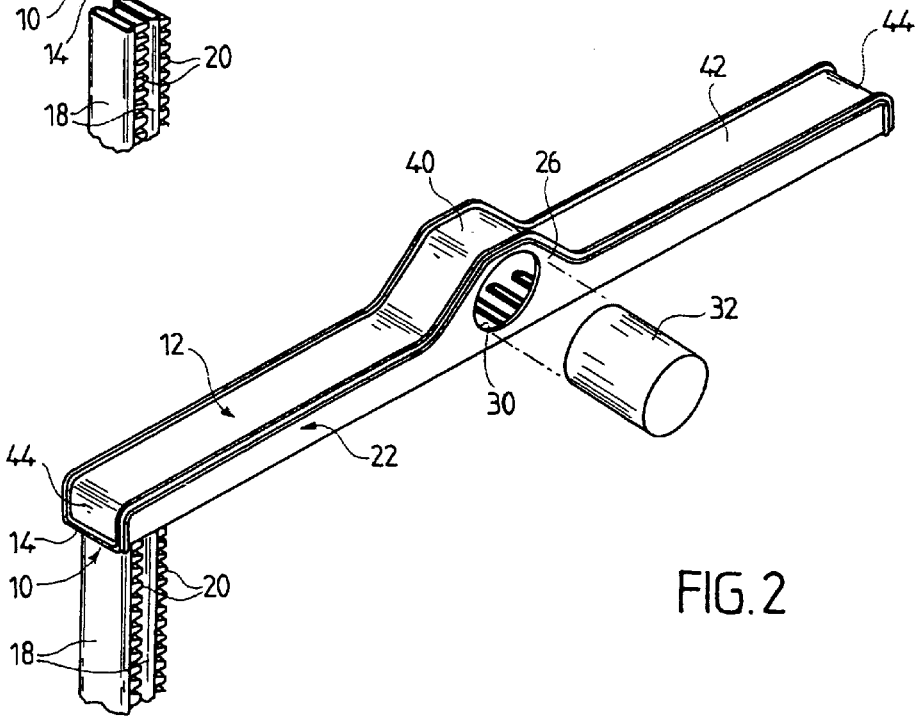
FIG. 2 is a view in perspective analogous to FIG. 1 after assembly of the manifold.
Figure 3:
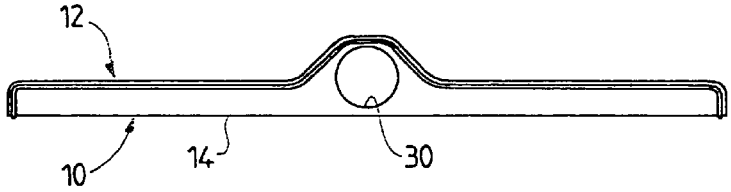
FIG. 3 is a side view corresponding to FIG. 2.
Figure 4:
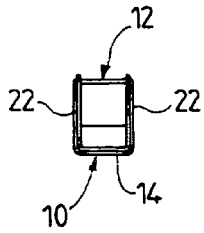
FIG. 4 is a sectional view along the line IV—IV of FIG. 3.
Figure 5:
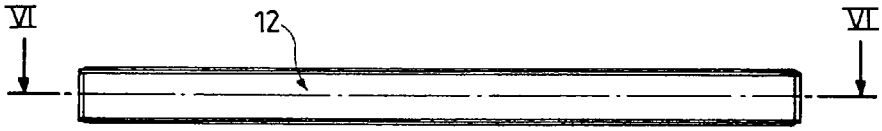
FIG. 5 is a top view of the manifold of FIG. 2.
Figure 6:
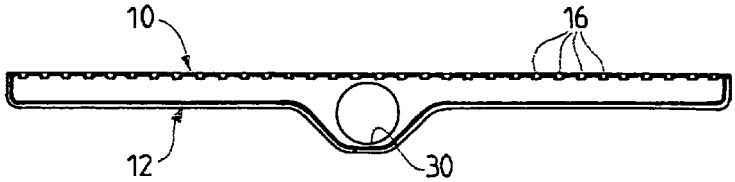
FIG. 6 is a sectional view along the line VI—VI of FIG. 5.
Figure 7:
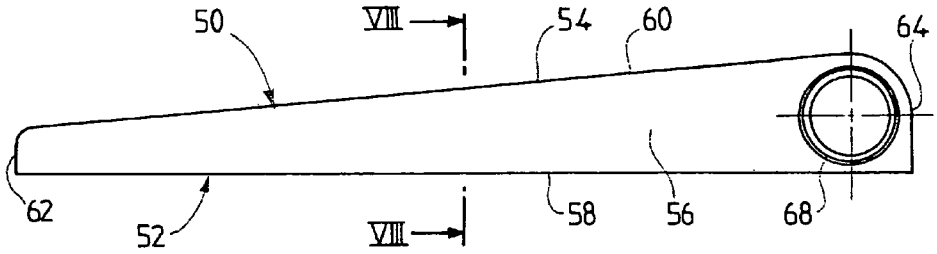
FIG. 7 is a side view of a manifold, in the assembled state, according to a second embodiment of the invention.
Figure 8:
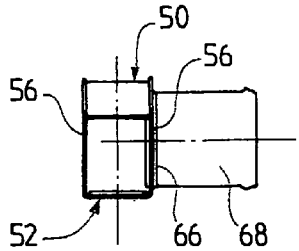
FIG. 8 is a sectional view along the line VIII—VIII of FIG. 7.

The first part 10 includes a bottom 14 which is generally flat and of elongate rectangular shape. This bottom 14 is intended to constitute the manifold plate, also called "hole plate", of the manifold. This bottom, to that end, includes a plurality of spaced holes 16 of elongate shape intended to accommodate tubes 18 forming part of a heat-exchanger core (FIGS. 1 and 2). In the example, these are flat tubes between which are arranged fins 20 produced in the form of corrugated spacers.

The sheet 10 further comprises two lateral walls 22 folded face-to-face, which are generally flat and parallel to each other. These walls are connected substantially perpendicularly to the bottom 14 by two fold lines 24 which are parallel to each other.

The lateral walls 22 are of elongate shape and include, in their central part, respective extensions 26 and 28 arranged face-to-face and each being in a "paper hat" shape. In the example, the extension 26 includes an aperture 30, while the extension 28 is completely closed. The aperture 30 is of circular shape and is intended to allow fitting of a pipe 32 of circular cross section.

Each of the lateral walls 22 includes a peripheral groove 34, which is continuous and ends in two end slots 36 which extend over the width of the bottom 14.

These grooves are intended to allow nested fitting of two longitudinal edges 38 of matching shape which the second part 12 includes. This second part is intended to form a cover so as to fit over the lateral walls 22 in such a way that, after nested fitting, these two parts jointly delimit a closed volume which communicates with the tubes of the core.

The second part 12 is obtained from a metal sheet of given width which possesses parallel generatrices. As can be seen more particularly in FIGS. 1, 3 and 7, this sheet includes a paper-hat-shaped central part 40 framed by two coplanar parts 42, which have respective extremities 44 folded at a right angle and able to come to engage in the grooves 36.

This second part 12 can thus be nested into the corresponding grooves 34 and 36 of the first part 10 in order to form an assembly (FIG. 2) ready to be brazed at the same time as the pipe 32.

It will be understood that it is thus possible, in a single operation, to produce a heat exchanger comprising a core formed by a multiplicity of tubes 18 and of fins 20, at the same time as one or two manifolds as defined above.

Figure 9:
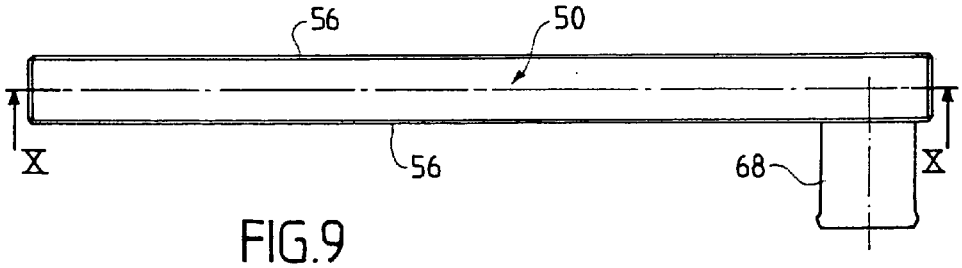
FIG. 9 is a top view corresponding to FIG. 7.
Figure 10:
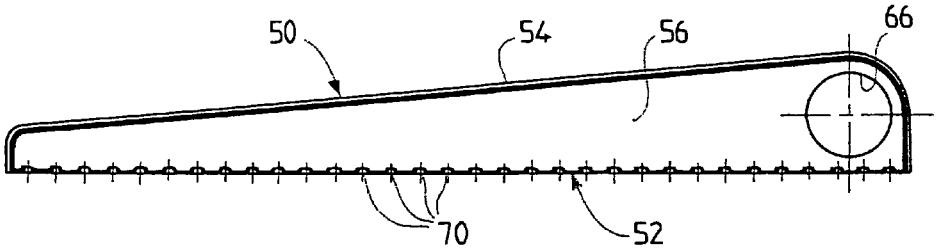
FIG. 10 is a sectional view along the line XI—XI of FIG. 9.

Referring now to the embodiment of FIGS. 7 to 10, in this second embodiment the manifold comprises a first part 50 and a second part 52 each formed from a shaped metal sheet, for example of aluminum. The first part 50 features a closed bottom 54 and two lateral walls 56 folded face-to-face. These two lateral walls 56 have a substantially trapezoidal oblong shape and are each delimited by a longitudinal edge 58, a non-parallel longitudinal edge 60 forming a fold line with the bottom 54, an end edge 62 and another end edge 64 which is partly rounded. This end edge 64 corresponds to a wider region of the wall 56 in which an aperture 66 is formed for receiving a pipe 68 (FIGS. 9 and 10). The other lateral wall 56 has a matching shape, but does not include an aperture.

It will be understood that the first part 50 can thus be produced by stamping in order to form a cup-shaped element which comprises the bottom 54 and the two lateral walls 56. The bottom 54 is defined by mutually parallel generatrices.

The first part 50 is stamped and thus defines a flat aperture of generally rectangular shape for accommodating the second part 52. This second part 52 is a metal piece of generally flat shape which here constitutes the manifold plate, also called hole plate, of the manifold. This part 52 thus forms a cover fitting over the first part, but this cover is equipped with a plurality of holes 70 for receiving tubes similar to the tubes 18 represented in FIG. 2.

Hence, in the embodiment of FIGS. 7 to 10, the manifold plate is included in the second cover-forming part, whereas in the embodiment of FIGS. 1 to 6 the manifold plate is included in the first part.

As in the case of the preceding embodiment, the two parts can be produced by conventional operations of cutting out and of stamping.

In the embodiment of FIGS. 11 to 17, the manifold comprises a first part 72 and a second part 74 each formed from a shaped metal sheet, for example of aluminum. The first part 72 features a closed bottom 76 and two lateral walls 78 folded face-to-face and connected substantially perpendicularly to the bottom 76. This bottom 76 forms a manifold plate and is provided with holes 80 (FIG. 15) for receiving tubes similar to those described previously.

Figure 11:
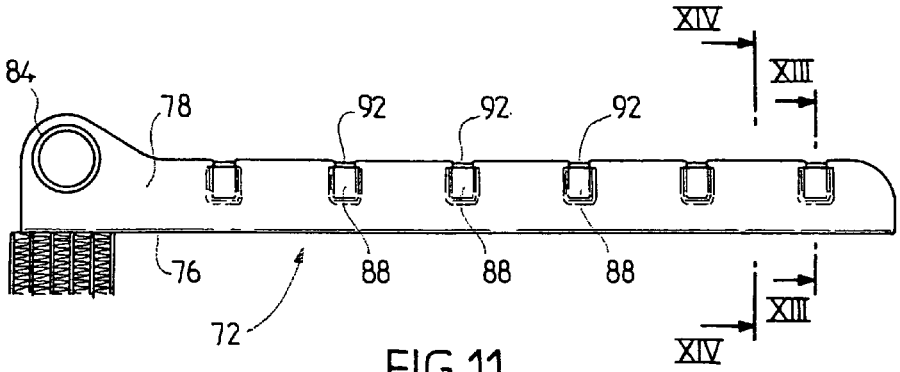
FIG. 11 is a side view of a manifold, in the assembled state, according to a third embodiment of the invention.
Figure 12:
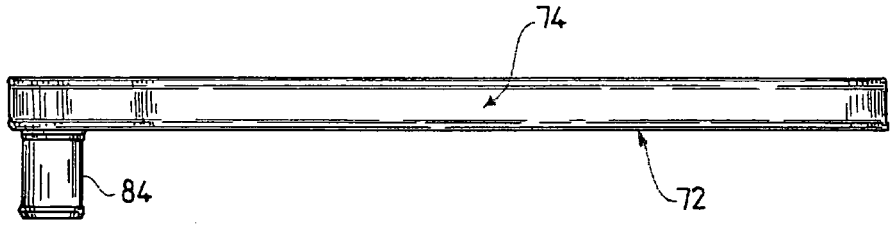
FIG. 12 is a top view corresponding to FIG. 11.

The two lateral walls 78 have an oblong shape and are especially each delimited by a longitudinal edge 82. The two lateral walls have wider face-to-face regions, which form extensions, and one of which includes an aperture receiving a pipe 84 (FIGS. 11 and 12).

It will be understood that the first part 72 can thus be produced by stamping in order to form a cup-shaped element which is intended to receive the second part 74 which forms a cover. This second part 74 is formed from a metal sheet with parallel generatrices, which is shaped so as to fit onto the edges of the first part and, in particular, onto the longitudinal edges 82 of the lateral walls 78.

The two lateral walls 78 each include a series of cut-outs 86, of generally rectangular shape, which delimit support regions 88 formed in projection from the inner side for accommodating a longitudinal edge 90 of the second part.

These support regions 88 are of generally rectangular shape and are each formed by stamping of the lateral walls 78 of the inner side.

Figure 13:
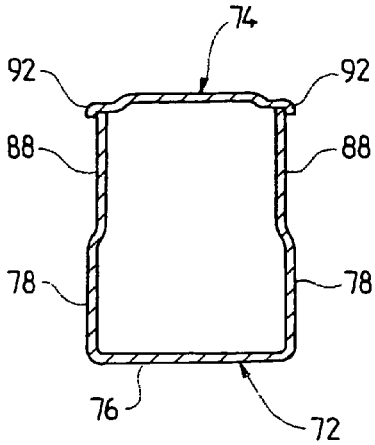
FIG. 13 is a sectional view along the line XIII—XIII of FIG. 11.
Figure 14:
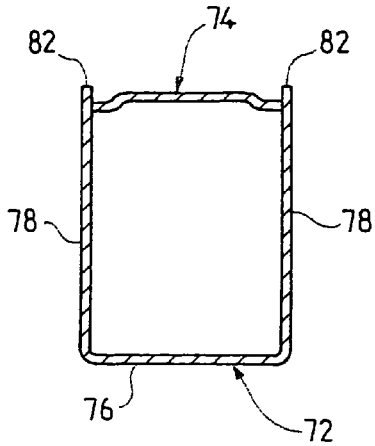
FIG. 14 is a sectional view along the line XIV—XIV of FIG. 11.
Figure 15:
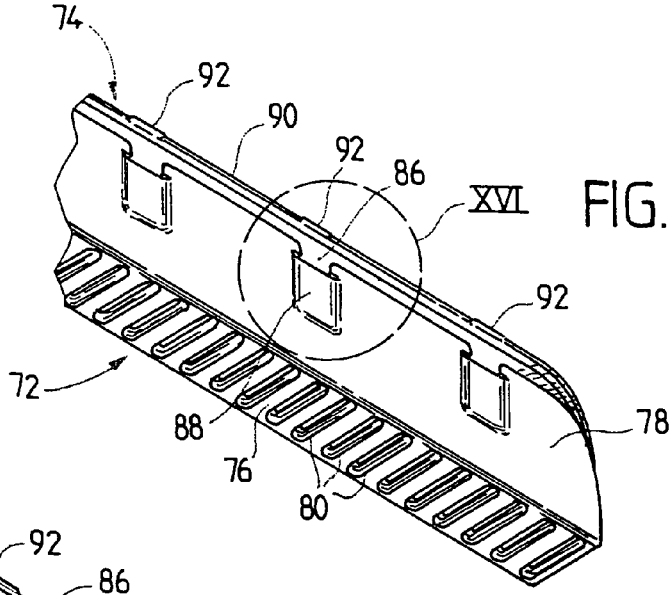
FIG. 15 is a partial view in perspective of the manifold of FIG. 11 before assembly.
Figure 16:
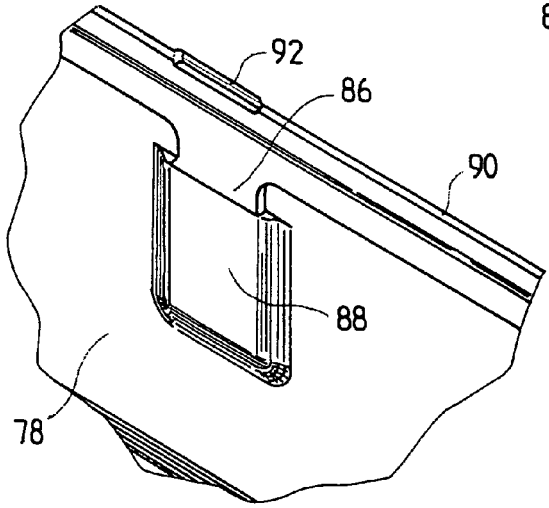
FIG. 16 represents the detail XVI, on an enlarged scale, of FIG. 15.
Figure 17:
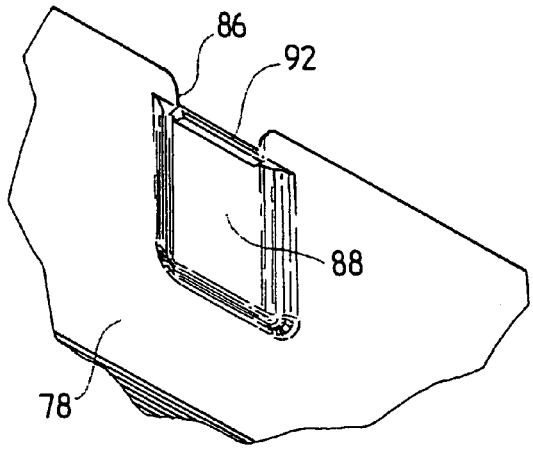
FIG. 17 represents the detail of FIG. 16, after assembly.

Each longitudinal edge 90 of the second part 74 is equipped with studs 92 formed in projection and able to engage respectively into the cut-outs 86 of the lateral walls 78 (FIGS. 15 to 17). These studs form folded lugs of short length which are lodged partly in the recesses formed on the outer side of the lateral walls because of the stamped support regions (FIG. 13).

Thus the two parts 74 and 76 are held temporarily in a correct position before brazing.

As in the case of the two preceding embodiments, the two parts can be produced by conventional operations of cutting out and of stamping.

After assembling of the two parts and of the pipe, the assembly can be brazed in an oven, at the same time as the rest of the heat exchanger to be manufactured.

Thus a brazing operation is carried out, during which all the elements of the heat exchanger are brazed, which simplifies the manufacturing operations.

The invention finds a particular application to the heat exchangers for motor vehicles in order to constitute, for example, a radiator for cooling the engine, or else a radiator for heating the passenger compartment.

Needless to say, the invention is not limited to the embodiments described above by way of example and extends to other variants.

In particular, the shaping of the first and second parts is capable of many variations, as is the shape of the lateral walls and the site at which the pipe or pipes is or are installed.

What is claimed is:

1. A manifold for a heat exchanger, having a manifold plate closed by a wall in such a way as to delimit a chamber into which at least one pipe opens out, wherein the manifold further comprises:

a first part formed from a shaped metal sheet featuring only one bottom and only two lateral walls folded face-to-face, at least one of which is provided with an aperture in order for a pipe to be fixed there, distal edges of the two lateral walls and the bottom of the first part define a continuous edge thereof, and a second part formed from a shaped metal sheet able to be fitted onto the lateral walls of the first part in order to form a cover opposite the bottom of the first part, the second part having a continuous edge complementary to the continuous edge of the first part, wherein one of the first part and the second part comprises the manifold plate, and wherein the first part and the second part are assembled by brazing along the entire continuous edges thereof so as to delimit the chamber solely by the first and second parts.

2. The manifold of claim 1, wherein the two lateral walls of the first part are generally flat and parallel to each other and are connected perpendicularly to the bottom.

3. The manifold of claim 1, wherein the continuous edge of the first part includes a peripheral groove for accommodating the continuous edge of the second part.

4. The manifold of claim 1, wherein the two lateral walls of the first part each include a series of cut-outs delimiting support regions formed in projection from the inner side for accommodating a longitudinal edge of the second part.

5. The manifold of claim 4, wherein the support regions are each formed by stamping 6*f* the lateral walls of the inner side.

6. The manifold of claim 4, wherein each longitudinal edge of the second part is equipped with projecting studs able to be engaged respectively in the cut-outs of the lateral walls.

7. The manifold of claim 1, wherein the second, cover-forming part is defined by a sheet which is shaped so as to have generatrices generally parallel to each other.

8. The manifold of claim 1, wherein the manifold plate is included in the bottom of the first part and is connected to the lateral walls, while the second part constitutes a closed cover.

9. The manifold of claim 8, wherein the lateral walls have respective face-to-face extensions, least one of which is provided with an aperture for fitting a pipe.

10. The manifold of claim 1, wherein manifold plate is included in the second part, while the bottom of the first part is closed and is connected e lateral walls.

11. The manifold of claim 10, wherein the first part and the second part are each obtained and cutting-out from a metal sheet component.

12. The manifold of claim 1, wherein the first part and the second part are each obtained from a sheet of a material comprising aluminum.

13. A heat exchanger comprising a manifold according to claim 1.

14. A manifold for a heat exchanger, having a manifold plate closed by a wall in such a way as to delimit a chamber into which at least one pipe opens out, wherein the manifold further comprises:

a first part formed from a shaped metal sheet featuring only one bottom and only two lateral walls folded face-to-face, at least one of which is provided with an aperture in order for a pipe to be fixed there, distal edges of the two lateral walls and the bottom of the first part define a continuous edge thereof, and a second part formed from a shaped metal sheet able to be fitted onto the lateral walls of the first part in order to form a cover opposite the bottom of the first part, the second part having a continuous edge complementary to the continuous edge of the first part, wherein one of the first part and the second part comprises the manifold plate, wherein the first part and the second part are assembled by brazing along the entire continuous edges thereof so as to delimit the chamber solely by the first and second parts, and wherein the manifold plate is included in the bottom of the first part and is connected to the lateral walls, and the second part constitutes a closed cover.

15. The manifold of claim 14, wherein the lateral walls have respective face-to-face extensions, least one of which is provided with an aperture for fitting a pipe.

* * * * *